US011820633B2

(12) United States Patent
Lee

(10) Patent No.: US 11,820,633 B2
(45) Date of Patent: Nov. 21, 2023

(54) PAYLOAD LIFTING DEVICE

(71) Applicant: MOTION DEVICE INC., Anyang-si (KR)

(72) Inventor: Jong Chan Lee, Anyang-si (KR)

(73) Assignee: MOTION DEVICE INC., Anyang-si (KR)

( * ) Notice: Subject to any disclaimer, the term of this patent is extended or adjusted under 35 U.S.C. 154(b) by 709 days.

(21) Appl. No.: 16/969,888

(22) PCT Filed: Dec. 27, 2019

(86) PCT No.: PCT/KR2019/018622
§ 371 (c)(1),
(2) Date: Aug. 13, 2020

(87) PCT Pub. No.: WO2021/125419
PCT Pub. Date: Jun. 24, 2021

(65) Prior Publication Data

US 2023/0101404 A1 Mar. 30, 2023

(30) Foreign Application Priority Data

Dec. 16, 2019 (KR) ..... 10-2019-0168188

(51) Int. Cl.
*B66F 9/065* (2006.01)
*B66F 9/20* (2006.01)
*B66F 9/24* (2006.01)

(52) U.S. Cl.
CPC ..... *B66F 9/065* (2013.01); *B66F 9/205* (2013.01); *B66F 9/24* (2013.01); *B66F 2700/09* (2013.01)

(58) Field of Classification Search
CPC .. B66F 9/065; B66F 9/35; B66F 9/205; B66F 9/063; B66F 9/02; B66F 3/20
See application file for complete search history.

(56) References Cited

U.S. PATENT DOCUMENTS 4,449,262 A * 5/1984 Jahsman ..... A61G 13/06 5/616
4,969,793 A * 11/1990 Pawl ..... B66F 7/0608 414/641

(Continued)

FOREIGN PATENT DOCUMENTS

KR 101772631 B1 9/2017

*Primary Examiner* — Seahee Hong
(74) *Attorney, Agent, or Firm* — STIP Law Group, LLC

(57) ABSTRACT

Disclosed is a payload lifting device capable of stably lifting a payload using one lift-driving unit. In the payload lifting device including a lift-driving portion configured to vertically lift a payload, the lift-driving portion includes lift-driving units configured to generate a driving force for vertically lifting the payload, a first power transmission portion including first power transmission members which vary in vertical positions and apply a vertically lifting force to one side of a bottom of the payload when a first rotational shaft rotated by the driving force of the lift-driving units rotates, and a second power transmission portion including second power transmission members which vary in vertical positions and apply a vertical lifting force to the other side of the bottom of the payload when a second rotational shaft rotated by the driving force of the lift-driving units rotates.

9 Claims, 12 Drawing Sheets

(56) References Cited

U.S. PATENT DOCUMENTS

| | | | | |
|---|---|---|---|---|
| 6,422,536 | B1 * | 7/2002 | Kelley | B66F 7/0641 254/10 R |
| 7,093,691 | B1 * | 8/2006 | Vaughan | B66B 9/0815 187/244 |
| 7,163,087 | B2 * | 1/2007 | Putnam | B66F 7/0641 187/203 |
| 9,266,704 | B1 * | 2/2016 | Hall | B66F 3/22 |
| 2013/0312551 | A1 * | 11/2013 | Ehrmann | B65B 65/02 74/44 |
| 2015/0014609 | A1 * | 1/2015 | Mohr | B66F 7/065 254/122 |

* cited by examiner

【FIG. 1】
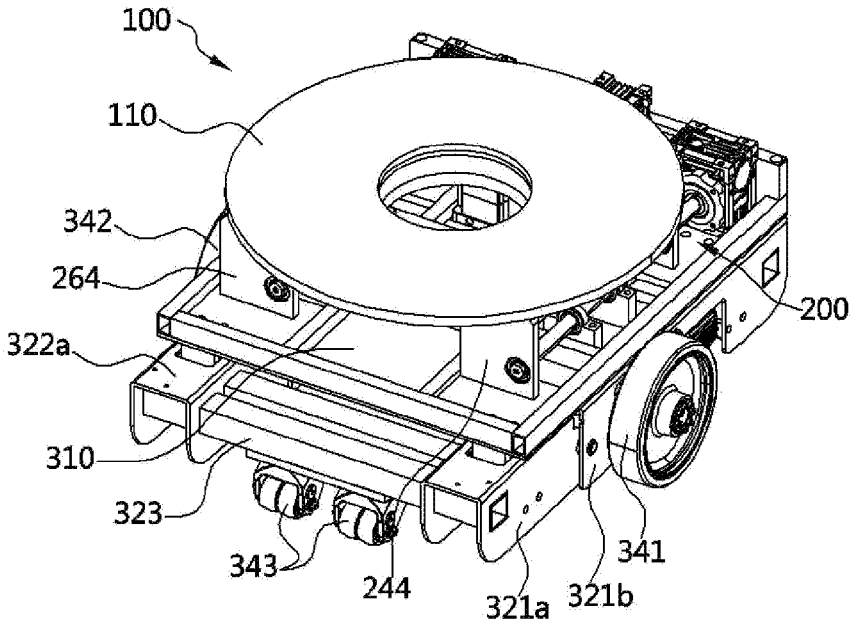
【FIG. 2】
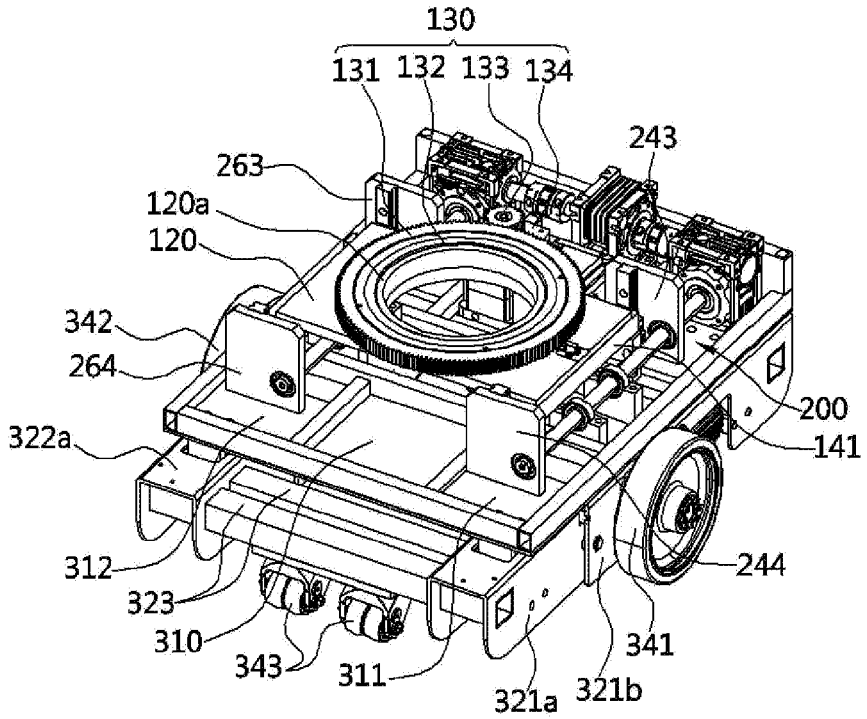

【FIG. 3】
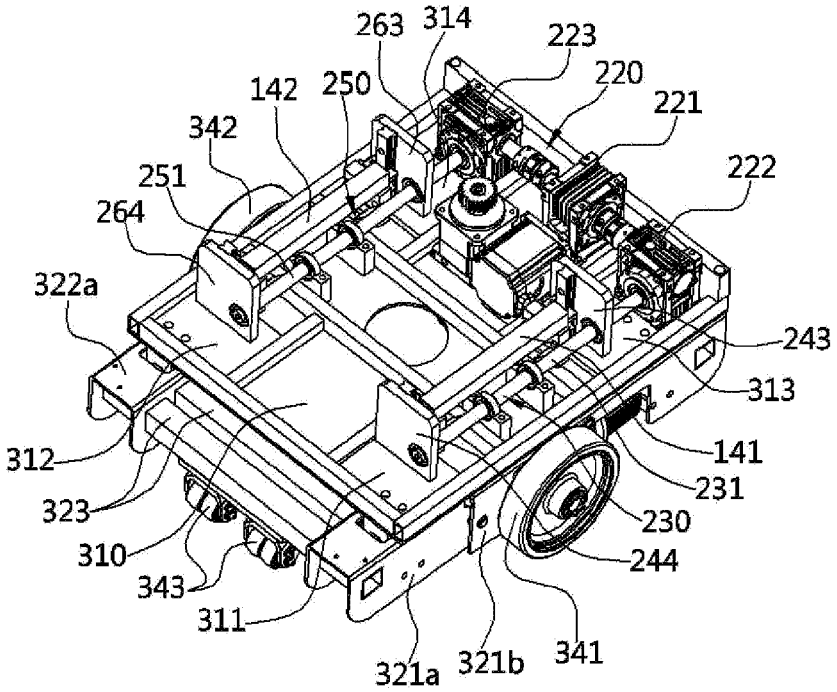
【FIG. 4】
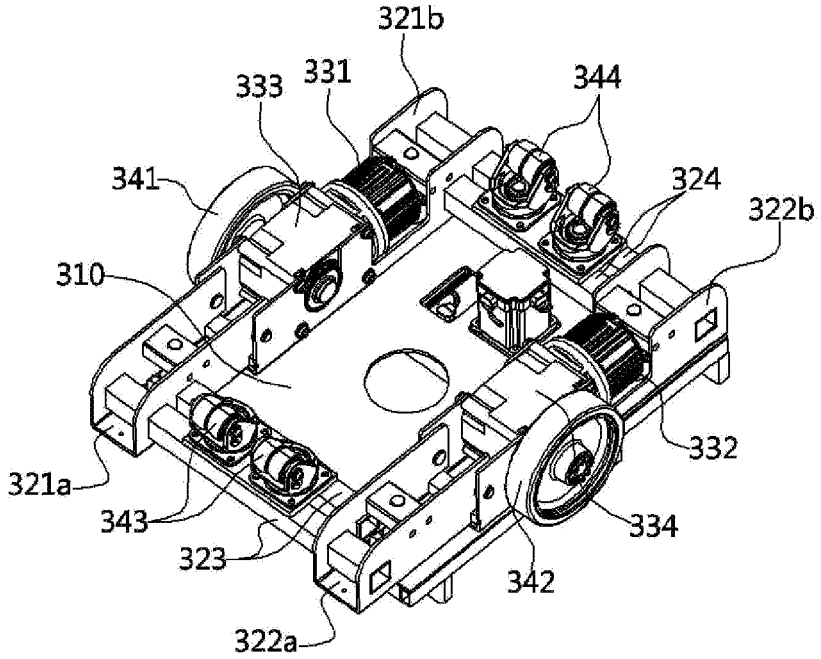

【FIG. 5】
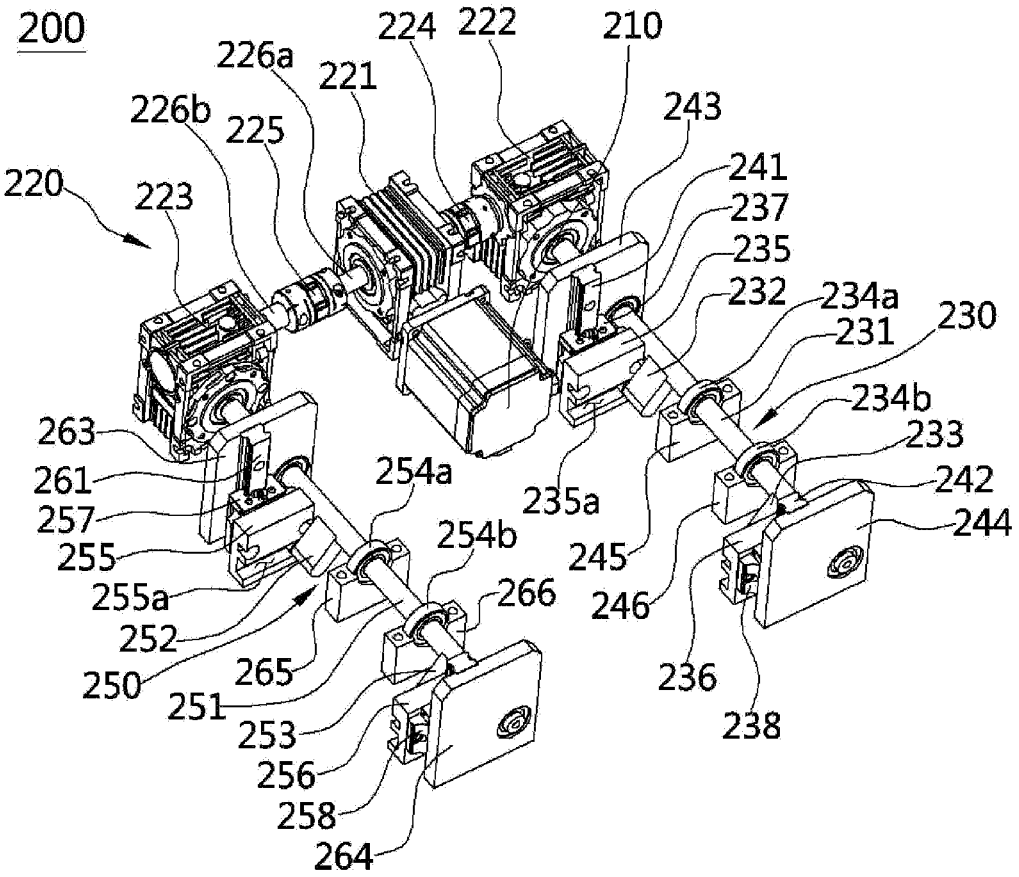

【FIG. 6】
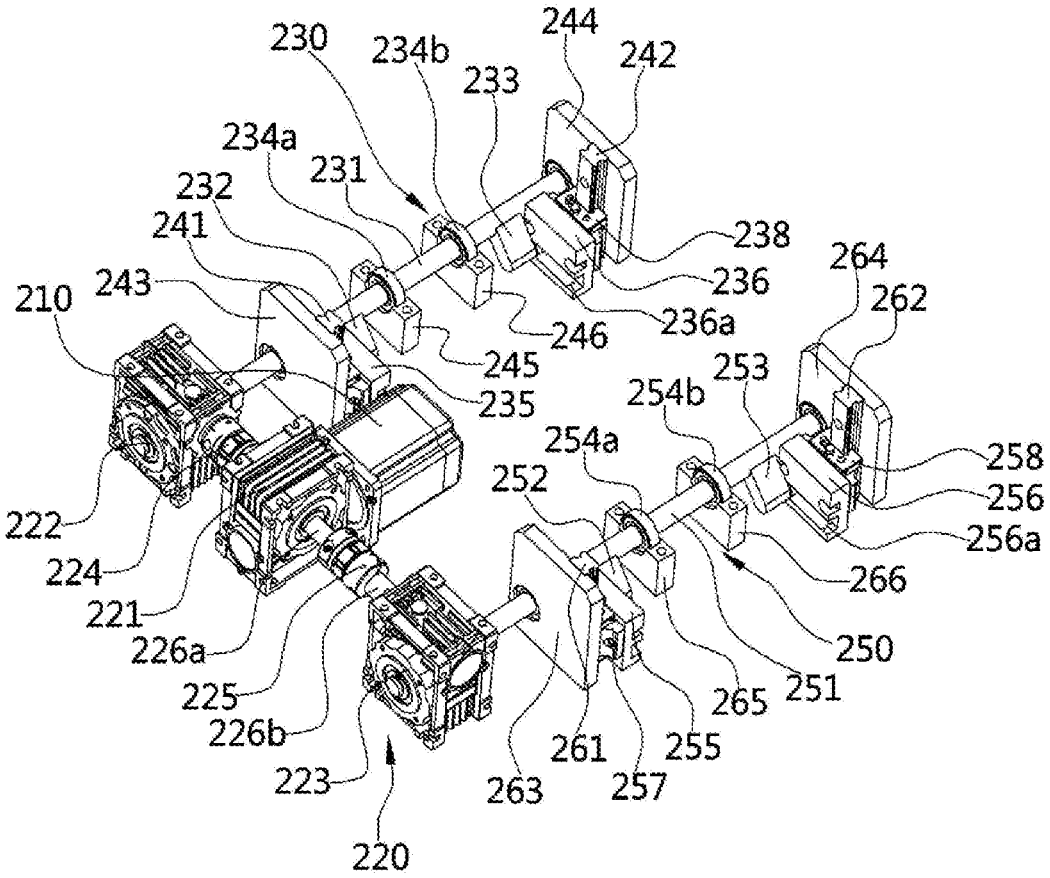

【FIG. 7】
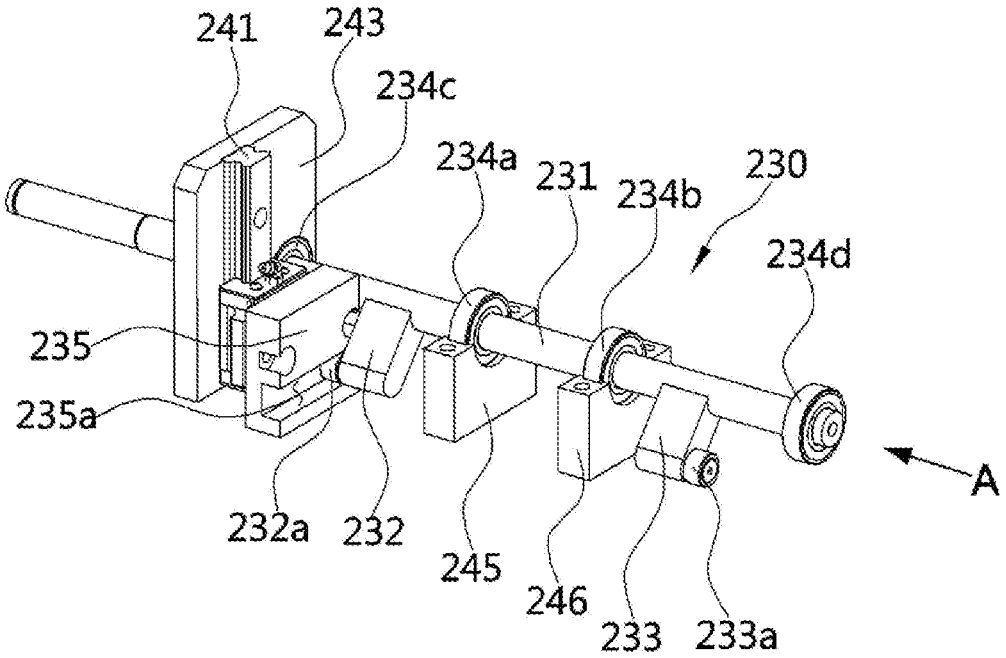

[FIG. 8A]
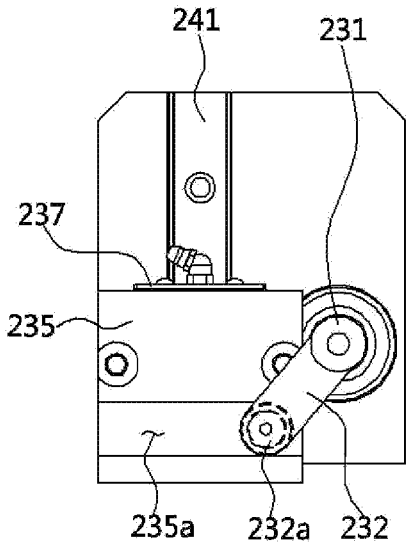
(a)
[FIG. 8B]
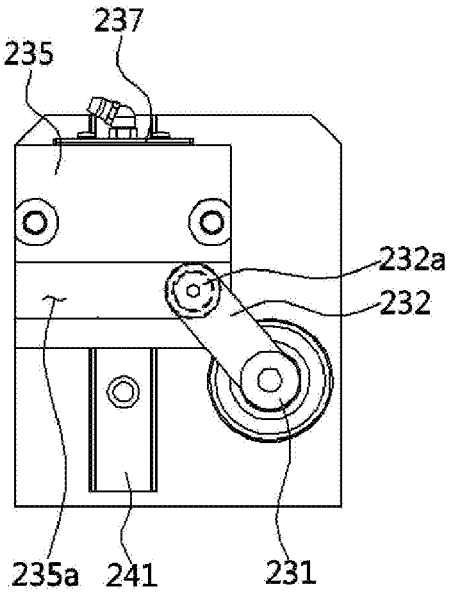
(b)

【FIG. 9】
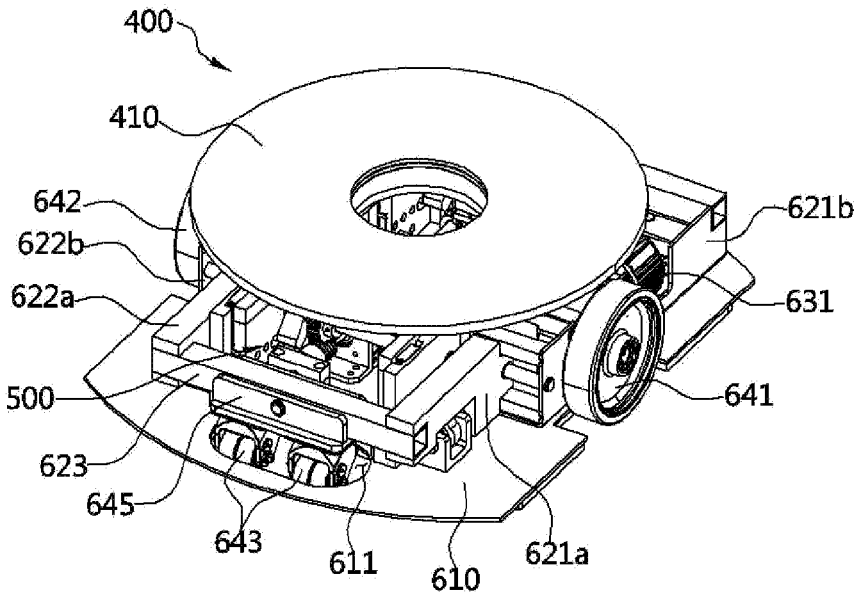
【FIG. 10】
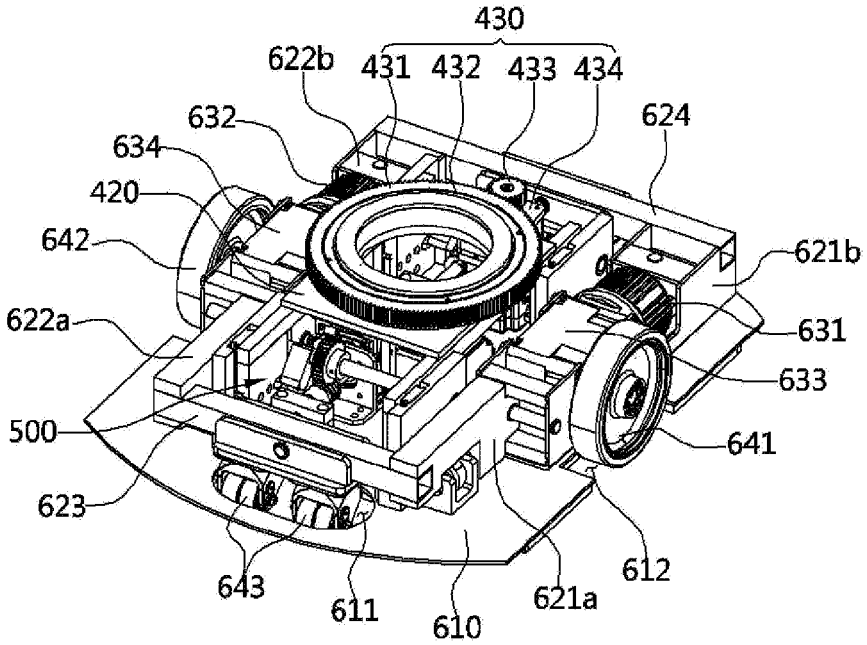

【FIG. 11】
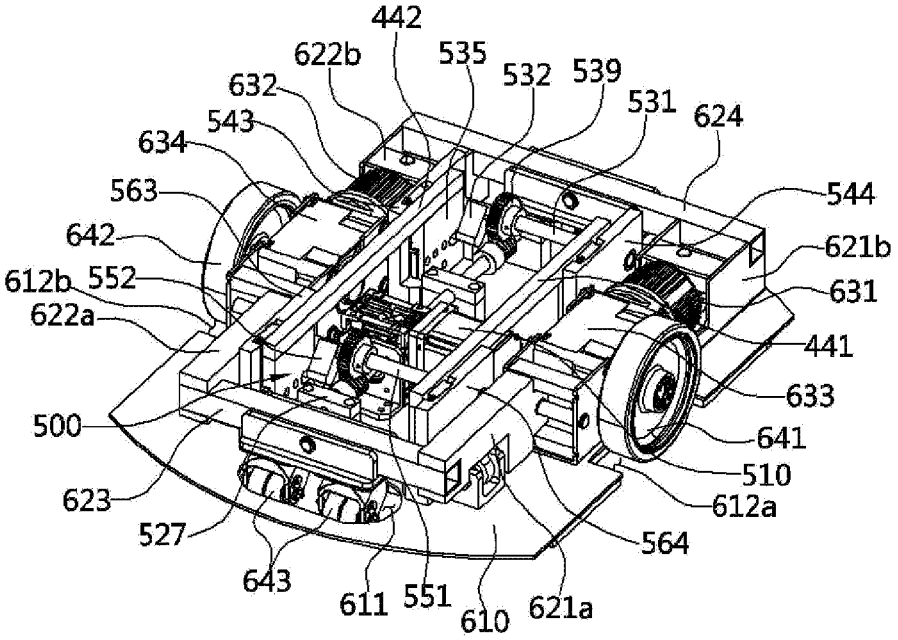

【FIG. 12】
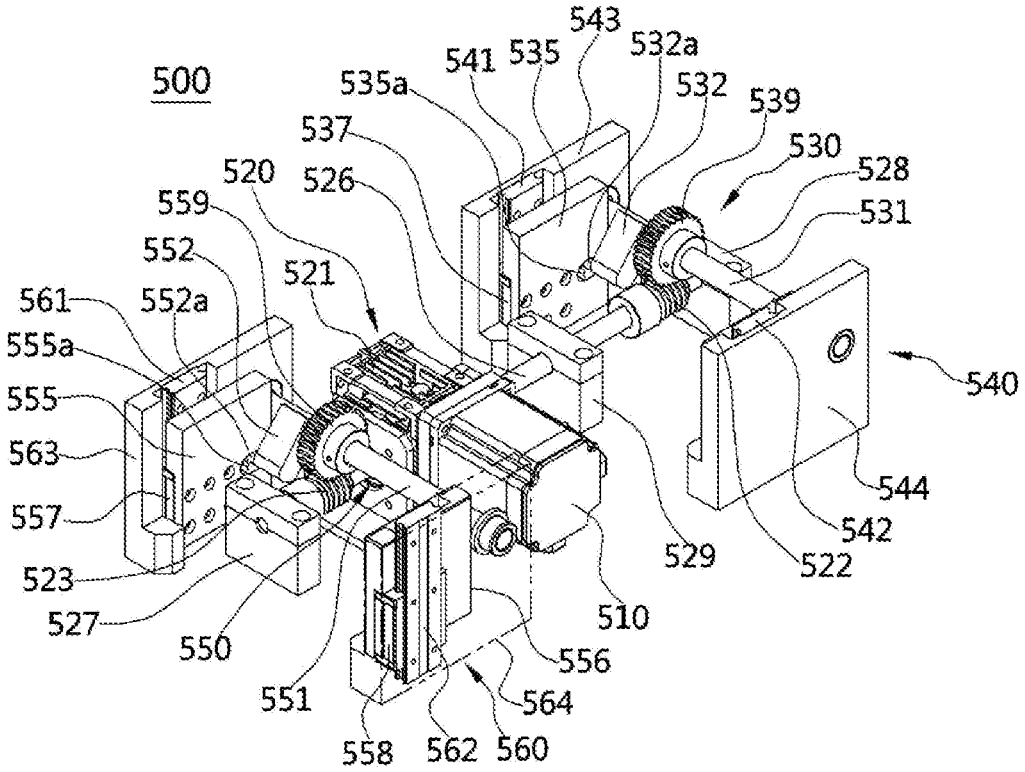

【FIG. 13】
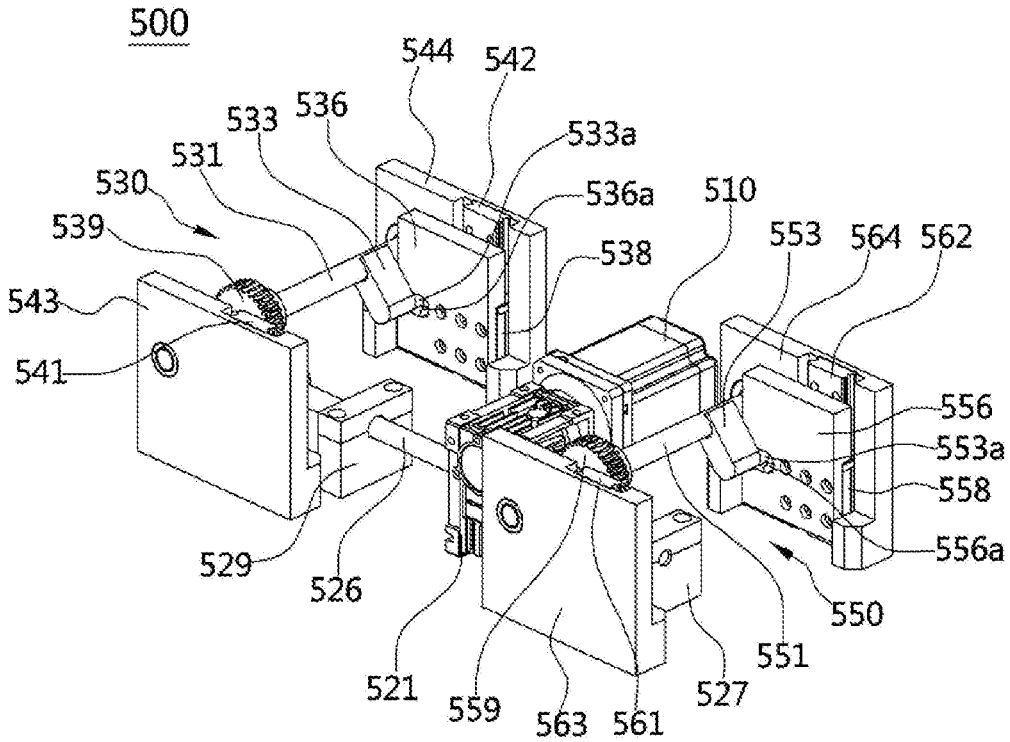

【FIG. 14】
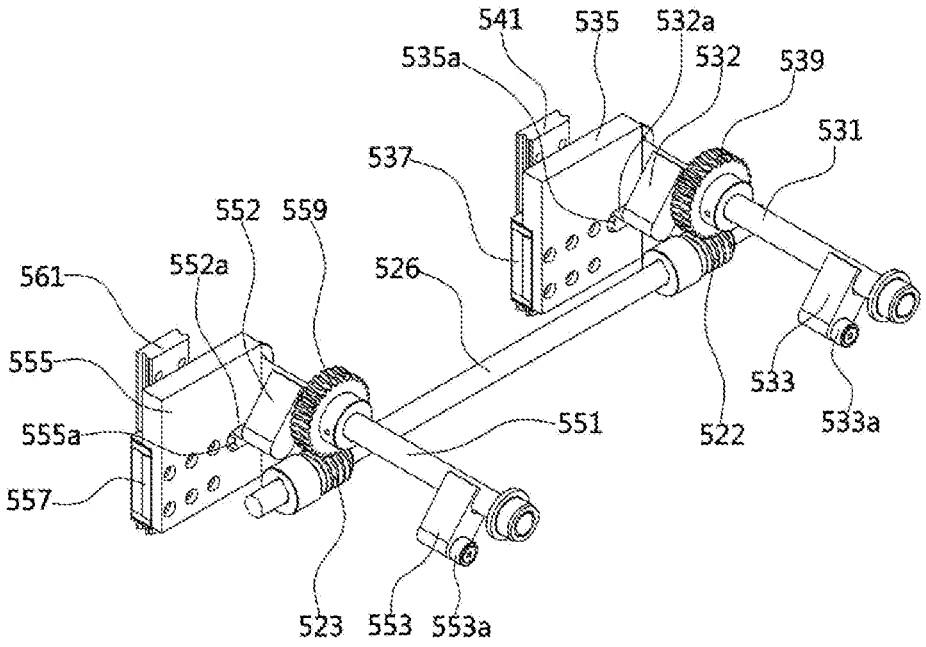

【FIG. 15】
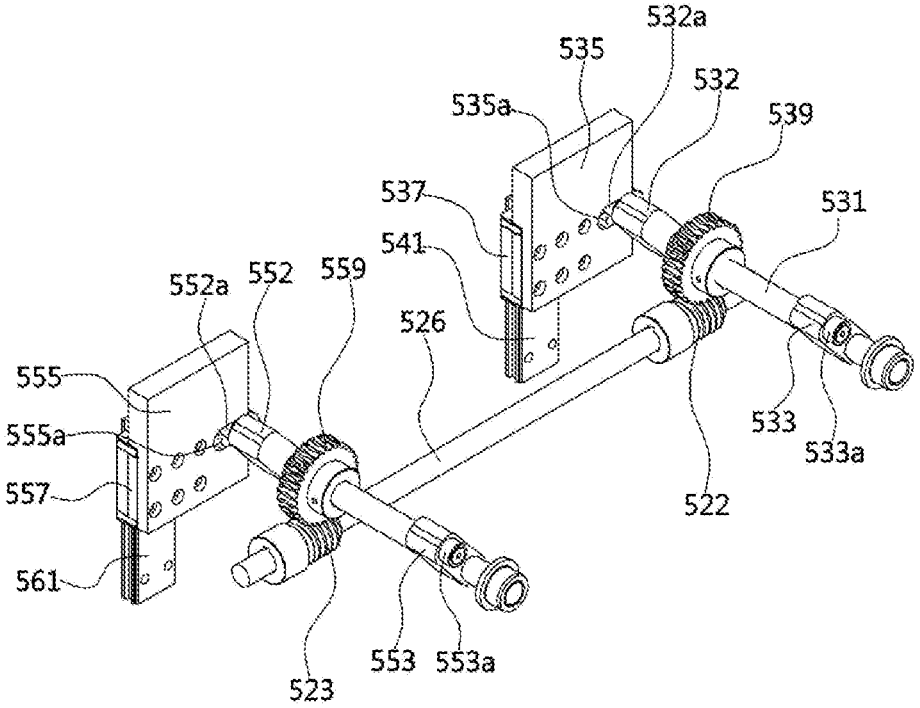

PAYLOAD LIFTING DEVICE

CROSS-REFERENCE TO RELATE APPLICATIONS

This application is the U.S. National Phase under 35 U.S.C. § 371 of International Application No. PCT/KR2019/018622 filed on Dec. 27, 2019, which in turn claims the benefit of Korean Application No. 10-2019-0168188, filed on Dec. 16, 2019, the disclosures of which are incorporated by reference into the present application.

BACKGROUND

1. Field of the Invention

The present invention relates to a payload lifting structure, and more particularly, to a payload lifting structure capable of stably lifting a payload using one lifting unit.

2. Discussion of Related Art

Recently, as the distribution industry has grown at a rapid pace, a variety of distribution systems have been developed. As an example, productivity is improved by increasing the efficiency of distribution management using load transportation robots.

Such load transportation robots linearly move while a payload is loaded thereon due to a driving motor and lifts a loading plate, on which the payload is loaded, using a lifting motor.

In order to lift the loading plate and the payload using the lifting motor, a complicated power transmission structure is necessary.

As related art, a conventional load transportation robot is disclosed in Korean Patent Registration No. 10-1772631.

SUMMARY OF THE INVENTION

The present invention is directed to providing a payload lifting device capable of stably lifting a payload using one lift-driving unit.

According to an aspect of the present invention, there is provided a payload lifting device including a lift-driving portion configured to vertically lift a payload. Here, the lift-driving portion includes lift-driving units configured to generate a driving force for vertically lifting the payload, a first power transmission portion including first power transmission members which vary in vertical positions and apply a vertically lifting force to one side of a bottom of the payload when a first rotational shaft rotated by the driving force of the lift-driving units rotates, and a second power transmission portion including second power transmission members which vary in vertical positions and apply a vertical lifting force to the other side of the bottom of the payload when a second rotational shaft rotated by the driving force of the lift-driving units rotates.

The first power transmission members may include cam members which protrude eccentrically outward from an outer circumferential surface of the first rotational and lifting members which linearly move in a vertical direction due to rotation of the cam members. Also, the second power transmission members may include cam members which protrude eccentrically outward from an outer circumferential surface of the second rotational shaft and lifting members which linearly move in a vertical direction due to rotation of the cam members.

The first rotational shaft and the second rotational shaft may be provided in parallel. A cam protruding portion protruding in a direction parallel to a longitudinal direction of the first rotational shaft and the second rotation shaft may be formed on one surface of each of the cam members. A guide groove having a concave shape to have a length in a direction perpendicular to the longitudinal direction of the first rotational shaft and the second rotational shaft on the basis of a plan view to allow the cam protruding portion to be inserted therein may be formed in each of the lifting members. When the cam member rotates, the cam protruding portion may horizontally move inside the guide groove.

A guide block may be coupled to the lifting member, and the guide block may be guided by a guide rail to be lifted.

The cam member and the lifting member of the first power transmission portion may be provided on each of both sides of the first rotational shaft, and the cam member and the lifting member of the second power transmission portion may be provided on each of both sides of the second rotational shaft.

The cam protruding portions of the cam members provided on both sides of the first power transmission portion may protrude in opposite directions, and the guide grooves of the lifting members on both sides of the first power transmission portion may be formed facing opposite directions. Also, the cam protruding portions of the cam members provided on both sides of the second power transmission portion may protrude in opposite directions, and the guide grooves of the lifting members on both sides of the second power transmission portion may be formed facing opposite directions.

At least one bearing fitted onto the first rotational shaft may be provided between the cam members on both sides of the first power transmission portion. At least one bearing fitted onto the second rotational shaft may be provided between the cam members on both sides of the second power transmission portion. A bearing-supporting block configured to support a bottom of the bearing may be provided at a position spaced apart from the cam members on both sides of the first power transmission portion. A bearing-supporting block configured to support a bottom of the bearing may be provided at a position spaced apart from the cam members on both sides of the second power transmission portion.

The lift-driving units may include a lifting motor and a deceleration portion configured to decelerate a rotational speed of the lifting motor. The deceleration portion may include a first decelerator connected to a motor shaft of the lifting motor and configured to transmit rotation of the lifting motor to a deceleration portion rotational shaft which meets the motor shaft at a right angle, a second decelerator connected to one end of the deceleration portion rotational shaft and configured to transmit rotation of the deceleration portion rotational shaft to the first rotational shaft which meets the deceleration portion rotational shaft at a right angle, and a third decelerator connected to the other end of the deceleration portion rotational shaft and configured to transmit rotation of the deceleration portion rotational shaft to the second rotational shaft which meets the deceleration portion rotational shaft at a right angle and is provided at a position facing the first rotational shaft.

The payload may further include a loading plate, a lifting member configured to vertically move according to vertical positional variation of the cam members, an upper support plate coupled to a top of the lifting member, and a rotary motor coupled to the upper support plate to rotate the loading plate. Here, the upper support plate and the rotary motor may vertically move with the lifting member.

The payload lifting device may further include a support ring member fixed to the upper support plate and having a ring shape, a bearing coupled to an outer circumference of the support ring member, and a rotation-driving ring gear rotatably coupled to an outer circumference of the bearing, engaged with a rotation-driving gear of the rotary motor, and above which the loading plate is loaded.

The lift-driving units may include a lifting motor, a decelerator configured to decelerate a rotation speed of the lifting motor, and a deceleration portion rotational shaft connected to the decelerator and having both ends provided in a middle position between the first rotational shaft and the second rotational shaft to transmit power thereto.

A first deceleration portion gear and a second deceleration portion gear may be provided on both sides of the deceleration portion rotational shaft. The first deceleration portion gear may be connected to a first rotational shaft gear provided on the first rotational shaft. The second deceleration portion gear may be connected to a second rotational shaft gear provided on the second rotational shaft.

The lift-driving units may include a lifting motor, at least one decelerator configured to decelerate a rotation speed of the lifting motor, and a deceleration portion rotational shaft connected to the decelerator and having both ends connected to one end of the first rotational shaft and one end of the second rotational shaft to transmit power thereto.

The payload lifting device may include a base plate above which the lift-driving portion is installed and which includes a plurality of cut-out portions and driving wheels and driven wheels which are coupled to frames provided above the base plate and configured to allow bottom surfaces thereof to come into contact with the ground through the cut-out portions.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of a payload lifting device according to a first embodiment of the present invention;

FIG. 2 is a perspective view illustrating a state in which a loading plate is removed from a state of FIG. 1;

FIG. 3 is a perspective view illustrating a state in which a rotationally-driving ring gear, a bearing, and an upper support plate are removed from the state shown in FIG. 2;

FIG. 4 is a bottom perspective view of the payload lifting device according to the first embodiment of the present invention;

FIG. 5 is a perspective view illustrating a lift-driving portion of the payload lifting device according to the first embodiment of the present invention;

FIG. 6 is a perspective view illustrating the lift-driving portion of FIG. 5 when viewed from another angle;

FIG. 7 is a perspective view illustrating a first power transmission portion of the payload lifting device according to the first embodiment of the present invention;

FIGS. 8A and 8B are views illustrating states in which a cam member is moved downward and upward respectively when viewed from a direction A in FIG. 7;

FIG. 9 is a perspective view of a payload lifting device according to a second embodiment of the present invention;

FIG. 10 is a perspective view illustrating a state in which a loading plate is removed from a state of FIG. 9;

FIG. 11 is a perspective view illustrating a state in which a rotationally-driving ring gear, a bearing, and an upper support plate are removed from the state shown in FIG. 10;

FIG. 12 is a perspective view illustrating a lift-driving portion of the payload lifting device according to the second embodiment of the present invention;

FIG. 13 is a perspective view illustrating the lift-driving portion of FIG. 12 when viewed from another angle;

FIG. 14 is a perspective view illustrating a state in which a cam member is moved downward in the payload lifting device according to the second embodiment of the present invention; and FIG. 15 is a perspective view illustrating a state in which the cam member is moved upward from a state of FIG. 14.

DETAILED DESCRIPTION OF EXEMPLARY EMBODIMENTS

Hereinafter, the present invention will be described in detail with reference to the attached drawings.

A payload lifting device according to the present invention may be applied to a load transportation robot, and additionally, applied to an apparatus capable of vertically moving a load in a variety of industrial fields. Also, the payload lifting device may be applied to a simulator which allows movements in virtual reality to be felt like reality.

First Embodiment

Referring to FIGS. 1 to 3, a payload lifting device according to a first embodiment of the present invention includes a lift-driving portion 200 configured to vertically move a payload 100.

The payload 100 includes all items vertically moved by the lift-driving portion 200. As an example, in the case of a load transportation robot, the payload 100 may include a loading plate 110 on which an item to be transported is loaded. In a structure in which a rotation-driving portion 130 configured to rotate the loading plate 110 also rotates with the loading plate 110 due to the lift-driving portion 200, the rotation-driving portion 130 may be included in the payload 100.

The rotation-driving portion 130 is provided below the loading plate 110, moves upward or downward with the loading plate 110, and rotates the loading plate 110.

To rotate the loading plate 110, the rotation-driving portion 130 includes a rotation-driving motor 134 configured to provide rotation-driving power, a rotation-driven gear 133 rotated by a rotational force of the rotation-driving motor 134, and a rotation-driving ring gear 131 engaged with the rotation-driven gear 133 to rotate with the rotation-driven gear 133.

Gear teeth on outer circumferential surfaces of the rotation-driven gear 133 and the rotation-driving ring gear 131 are engaged with each other and rotate together. A bearing 132 is coupled to an inner surface of the rotation-driving ring gear 131.

The rotation-driving portion 130 is provided on an upper support plate 120 and moves upward or downward as the upper support plate 120 moves upward or downward.

A through hole is formed in a central part of the upper support plate 120, and an upper support plate flange portion 120*a* extending upward from an inner end of the upper support plate 120 is formed along a periphery of the through hole.

The bearing 132 is coupled to an outside of the flange portion 120*a* and configured so that an outer surface of the flange portion 120*a* comes into contact with an inner ring of the bearing 132. Also, an outer ring of the bearing 132 is configured to come into contact with an inner surface of the rotation-driving ring gear 131. Accordingly, the rotation-driving ring gear 131 is rotatably installed by the bearing 132 with respect to the flange portion 120*a* of the upper support plate 120.

The lift-driving portion 200 is installed above a quadrangular-panel-shaped base plate 310. A plurality of quadrangular-panel-shaped bottom plates 311, 312, 313, and 314 are stacked on four upper corner portions of the base plate 310.

Driving portion support plates 243, 244, 263, and 264 are erectly installed on the plurality of bottom plates 311, 312, 313, and 314, respectively. The driving portion support plates 243, 244, 263, and 264 have a quadrangular plate shape, guide rails 241, 242, 261, and 262 are coupled, and both ends of a first rotational shaft 231 and a second rotational shaft 251 are rotatably supported.

Referring to FIG. 4, components for linear movement are provided below the base plate 310.

Below the base plate 310, a first lower frame 321*a* and 321*b* having a front-rear length, a second lower frame 322*a* and 322*b* formed on a side opposite to the first lower frame 321*a* and 321*b* to have a shape symmetrical to that of the first lower frame 321*a* and 321*b*, a first connection frame 323 configured to connect inner surfaces of one sides of the first lower frame 321*a* and 321*b* and the second lower frame 322*a* and 322*b*, and a second connection frame 324 configured to connect inner surfaces of other sides of the first lower frame 321*a* and 321*b* and the second lower frame 322*a* and 322*b*.

On the first lower frame 321*a* and 321*b*, a first driving motor 331 configured to provide a driving force for linear movement and a decelerator 333 are provided and a driving wheel 341 connected to the decelerator 333 and rotated by driving of the first driving motor 331 is provided.

On the second lower frame 322*a* and 322*b*, a second driving motor 332 configured to provide a driving force for linear movement and a decelerator 334 are provided and a driving wheel 342 connected to the decelerator 334 and rotated by driving of the second driving motor 332 is provided.

Driven wheels 343 are coupled to a bottom surface of the first connection frame 323, and driven wheels 344 are coupled to a bottom surface of the second connection frame 324.

Components of the lift-driving portion 200 according to the first embodiment of the present invention will be described with reference to FIGS. 5 to 7.

The lift-driving portion 200 includes lift-driving units 210 and 220 configured to generate a driving force for vertically lifting the payload 100, a first power transmission portion 230 including first power transmission members 232, 235, 237, 241, 233, 236, 238, and 242 which vary in vertical positions and apply a vertically lifting force to one side of a bottom of the payload 100 when the first rotational shaft 231 rotated by the driving force of the lift-driving units 210 and 220 rotates, and a second power transmission portion 250 including second power transmission members 252, 255, 257, 261, 253, 256, 258, and 262 which vary in vertical positions and apply a vertically lifting force to the other side of the bottom of the payload 100 when the second rotational shaft 251 rotated by the driving force of the lift-driving units 210 and 220 rotates.

The lift-driving units 210 and 220 may include a lifting motor 210 configured to provide a driving force of lifting the payload 100 and a deceleration portion 220 configured to decelerate a rotational speed of the lifting motor 210.

The lifting motor 210 may be provided between the first power transmission portion 230 and the second power transmission portion 250.

The deceleration portion 220 includes a first decelerator 221 connected to a motor shaft of the lifting motor 210 and configured to transmit the rotation of the lifting motor 210 to deceleration portion rotational shafts 226*a* and 226*b* which meet the motor shaft of the lifting motor 210 at a right angle, a second decelerator 222 connected to one end of the deceleration portion rotational shafts 226*a* and 226*b*, and a third decelerator 223 connected to the other end of the deceleration portion rotational shafts 226*a* and 226*b*.

The first decelerator 221 and the second decelerator 222 may be connected by the deceleration portion rotational shafts, and the deceleration portion rotational shafts may be connected by a coupler 224 interposed therebetween. The first decelerator 221 and the third decelerator 223 may be connected by the deceleration portion rotational shafts 226*a* and 226*b*, and the deceleration portion rotational shafts 226*a* and 226*b* may be connected by a coupler 225 interposed therebetween. The deceleration portion rotational shafts configured to connect the first decelerator 221 to the second decelerator 222 and the deceleration portion rotational shafts 226*a* and 226*b* configured to connect the first decelerator 221 to the third decelerator 223 may include a plurality of rotational shafts but may be defined as one connected deceleration portion rotational shaft in terms of transmitting rotation.

The second decelerator 222 is provided on one end of the deceleration portion rotation shaft and transmits the rotation of the deceleration portion rotational shafts to the first rotational shaft 231 which meets the deceleration portion rotational shafts at a right angle.

The third decelerator 223 is provided on the other end of the deceleration portion rotational shafts and transmits the rotation of the deceleration portion rotational shafts to the second rotational shaft 251, which meets the deceleration portion rotational shafts at a right angle, provided at a position facing the first rotational shaft 231 to be parallel to the first rotational shaft 231.

The first decelerator 221, the second decelerator 222, and the third decelerator 223 are connected in a worm-gear manner and transmit rotation between two intersecting shafts.

The first power transmission portion 230 may include the first rotational shaft 231, cam members 232, and 233, and lifting members 235 and 236.

One end of the first rotational shaft 231 is connected to the second decelerator 222, and the first rotational shaft 231 is rotatably supported by a plurality of components along a longitudinal direction.

The first rotational shaft 231 at a position close to the second decelerator 222 passes through the driving portion support plate 243, and a bearing is disposed at a part, through which the first rotational shaft 231 passes, to rotatably support the first rotational shaft 231. The other end of the first rotational shaft 231 passes through the driving portion support plate 244, and a bearing is disposed at a part, through which the other end passes, to rotatably support the first rotational shaft 231.

The cam members 232 and 233 may form one pair. Between the pair of cam members 232 and 233, a pair of bearing-supporting blocks 245 and 246 are provided at positions spaced apart from the pair of cam members 232 and 233, respectively. Semicircular shapes are concavely formed on top ends of the bearing-supporting blocks 245 and 246, and bearings 234*a* and 234*b* fitted onto the first rotational shaft 231 are mounted on concave parts of the semicircular shapes.

The first rotational shaft 231 is rotatably supported by the above components at a plurality of positions along a longitudinal direction.

The first power transmission members 232, 235, 241, 233, 236, and 242 include the cam members 232 and 233, which protrude eccentrically outward from an outer circumferential surface of the first rotational shaft 231, the lifting members 235 and 236 linearly moved in a vertical direction by the rotation of the cam members 232 and 233, and guide rails 241 and 242 configured to guide the linear movement of the lifting members 235 and 236.

The cam members 232 and 233 and the lifting members 235 and 236 may be provided one by one to apply a vertically lifting force to one side of the payload 100. In the embodiment, the pair of cam members 232 and 233 and a pair of the lifting members 235 and 236 are provided between a pair of the support plates 243 and 244.

On the cam member 232 protruding eccentrically outward from an outer circumferential surface of one side of the first rotational shaft 231, a cam protruding portion 232*a* having an approximate quadrangular shape and protruding from one surface of an outer end of the quadrangular shape in a direction parallel to a longitudinal direction of the first rotational shaft 231 is formed.

Also, on the cam member 233 protruding eccentrically outward from an outer circumferential surface of the other side of the first rotational shaft 231, a cam protruding portion 233*a* having an approximate quadrangular shape and protruding from one surface of an outer end of the quadrangular shape in a direction parallel to the longitudinal direction of the first rotational shaft 231 is formed.

The cam member 232 on the one side and the cam member 233 on the other side are formed at the same angle with respect to the first rotational shaft 231. That is, when viewed from an axial direction of the first rotational shaft 231, a phase of the cam member 232 on the one side is equal to a phase of the cam member 233 on the other side. Accordingly, when the first rotational shaft 231 rotates, the cam member 232 on the one side and the cam member 233 on the other side rotate together in the same phase and apply lifting forces to a bottom of one side of the payload 100 at the same time.

The cam protruding portion 232*a* on the one side protrudes from the cam member 232 toward the second decelerator 222, and the cam protruding portion 233*a* on the other side protrudes in a direction opposite that of the cam protruding portion 232*a*.

The pair of lifting members 235 and 236 include a lifting member 235 caught by the cam protruding portion 232*a* on the one side and lifted in a vertical direction and a lifting member 236 caught by the cam protruding portion 233*a* on the other side and lifted in a vertical direction.

The lifting member 235 on the one side has a hexahedral shape having a small thickness and include a guide groove 235*a* having a concave shape to have a length in a direction perpendicular to the longitudinal direction of the first rotational shaft 231 on the basis of a plan view so as to allow the cam protruding portion 232*a* to be inserted therein. The cam protruding portion 232*a* is guided inside the guide groove 235*a* and horizontally moves when the cam member 232 rotates.

The lifting member 236 on the other side has a shape symmetrical to the lifting member 235 on the one side. That is, the lifting member 236 includes a guide groove 235*a* having a concave shape to have a length in a direction perpendicular to the longitudinal direction of the first rotational shaft 231 on the basis of a plan view so as to allow the cam protruding portion 233*a* to be inserted therein. The cam protruding portion 233*a* is guided inside the guide groove 236*a* and horizontally moves when the cam member 233 rotates.

The guide groove 235*a* of the lifting member 235 on the one side and the guide groove 236*a* of the lifting member 236 on the other side may be formed to face in opposite directions.

In the first embodiment, the guide groove 235*a* on the one side and the guide groove 236*a* on the other side are configured to face each other but may be formed to face in opposite directions. That is, positions of the cam member 232 and the lifting member 235 on the one side may be reversed, positions of the cam member 233 and the lifting member 235 on the other side may be reversed, the cam protruding portion 232*a* on the one side and the cam protruding portion 233*a* on the other side may be configured to face each other, and the guide groove 235*a* on the one side and the guide groove 236*a* on the other side may be configured to face each other.

The guide rails 241 and 242 guide vertical movements of the lifting members 235 and 236.

Guide blocks 237 and 238 may be provided between the guide rails 241 and 242 and the lifting members 235 and 236.

The lifting member 235 on the one side is coupled to the guide block 237 by a fastening member (not shown), and the guide block 237 is guided by the guide rail 241 having a vertical length to be lifted. The guide block 237 and the guide rail 241 may be formed, for example, as a linear motion (LM) guide.

The lifting member 236 on the other side is coupled to the guide block 238 by a fastening member (not shown), and the guide block 238 is guided by the guide rail 242 having a vertical length to be lifted. The guide block 238 and the guide rail 242 may be formed, for example, as an LM guide.

The guide rail 241 on the one side is integrally coupled to the driving portion support plate 243 on the one side, and the guide rail 242 on the other side is integrally coupled to the driving portion support plate 244 on the other side.

The cam member 232, the cam protruding portion 232*a*, the lifting member 235, the guide block 237, and the guide rail 241 on the one side included in the first power transmission portion 230 may be provided to be symmetrical to the cam member 233, the cam protruding portion 233*a*, the lifting member 236, the guide block 238, and the guide rail 242 on the other side.

The second power transmission portion 250 may include the second rotational shaft 251, cam members 252, and 253, and lifting members 255 and 256.

One end of the second rotational shaft 251 is connected to the third decelerator 223, and the second rotational shaft 251 is rotatably supported by a plurality of components along a longitudinal direction.

The second rotational shaft 251 at a position close to the third decelerator 223 passes through the driving portion support plate 263, and a bearing is disposed at a part, through which the second rotational shaft 251 passes, to rotatably support the second rotational shaft 251. The other end of the second rotational shaft 251 passes through the driving portion support plate 264, and a bearing is disposed at a part, through which the other end passes, to rotatably support the second rotational shaft 251.

The cam members 252 and 253 may form one pair. Between the pair of cam members 252 and 253, a pair of bearing-supporting blocks 265 and 266 are provided at positions spaced apart from the pair of cam members 252 and 253, respectively. Semicircular shapes are concavely formed on top ends of the bearing-supporting blocks 265 and 266, and bearings 254*a* and 254*b* fitted onto the second rotational shaft 251 are mounted on concave parts of the semicircular shapes.

The second rotational shaft 251 is rotatably supported by the above components at a plurality of positions along a longitudinal direction.

The second power transmission members 252, 255, 261; 253, 256, and 262 include the cam members 252 and 253, which protrude eccentrically outward from an outer circumferential surface of the second rotational shaft 251, the lifting members 255 and 256 linearly moved in a vertical direction by the rotation of the cam members 252 and 253, and guide rails 261 and 262 configured to guide the linear movement of the lifting members 255 and 256.

The cam members 252 and 253 and the lifting members 255 and 256 may be provided one by one to apply a vertically lifting force to the other side of the payload 100. In the embodiment, the pair of cam members 252 and 253 and a pair of the lifting members 255 and 256 are provided between a pair of the support plates 263 and 264.

On the cam member 252 protruding eccentrically outward from an outer circumferential surface of one side of the second rotational shaft 251, a cam protruding portion 252*a* having an approximate quadrangular shape and protruding from one surface of an outer end of the quadrangular shape in a direction parallel to a longitudinal direction of the second rotational shaft 251 is formed.

Also, on the cam member 253 protruding eccentrically outward from an outer circumferential surface of the other side of the second rotational shaft 251, a cam protruding portion 253*a* having an approximate quadrangular shape and protruding from one surface of an outer end of the quadrangular shape in a direction parallel to the longitudinal direction of the second rotational shaft 251 is formed.

The cam member 252 on the one side and the cam member 253 on the other side are formed at the same angle with respect to the second rotational shaft 251. That is, when viewed from an axial direction of the second rotational shaft 251, a phase of the cam member 252 on the one side is equal to a phase of the cam member 253 on the other side. Accordingly, when the second rotational shaft 251 rotates, the cam member 252 on the one side and the cam member 253 on the other side rotate together in the same phase and apply lifting forces to a bottom of the other side of the payload 100 at the same time.

The cam protruding portion 252*a* on the one side protrudes from the cam member 252 toward the third decelerator 223, and the cam protruding portion 253*a* on the other side protrudes in a direction opposite that of the cam protruding portion 252*a* on the one side.

The pair of lifting members 255 and 256 include a lifting member 255 caught by the cam protruding portion 252*a* on the one side and lifted in a vertical direction and a lifting member 256 caught by the cam protruding portion 253*a* on the other side and lifted in a vertical direction.

The lifting member 255 on the one side has a hexahedral shape having a small thickness and include a guide groove 255*a* having a concave shape to have a length in a direction perpendicular to the longitudinal direction of the second rotational shaft 251 on the basis of a plan view so as to allow the cam protruding portion 252*a* to be inserted therein. The cam protruding portion 252*a* is guided inside the guide groove 255*a* and horizontally moves when the cam member 252 rotates.

The lifting member 256 on the other side has a shape symmetrical to the lifting member 255 on the one side. That is, the lifting member 256 includes a guide groove 256*a* having a concave shape to have a length in a direction perpendicular to the longitudinal direction of the second rotational shaft 251 on the basis of a plan view so as to allow the cam protruding portion 253*a* to be inserted therein. The cam protruding portion 253*a* is guided inside the guide groove 256*a* and horizontally moves when the cam member 253 rotates.

The guide groove 255*a* of the lifting member 255 on the one side and the guide groove 256*a* of the lifting member 256 on the other side may be formed to face in opposite directions.

In the embodiment, the guide groove 255*a* on the one side and the guide groove 256*a* on the other side are configured to face each other but may be formed to face in opposite directions. That is, positions of the cam member 252 and the lifting member 255 on the one side may be reversed, positions of the cam member 253 and the lifting member 256 on the other side may be reversed, the cam protruding portion 252*a* on the one side and the cam protruding portion 253*a* on the other side may be configured to face each other, and the guide groove 255*a* on the one side and the guide groove 256*a* on the other side may be configured to face each other.

The guide rails 261 and 262 guide vertical movements of the lifting members 255 and 256.

Guide blocks 257 and 258 may be provided between the guide rails 261 and 262 and the lifting members 255 and 256.

The lifting member 255 on the one side is coupled to the guide block 257 by a fastening member (not shown), and the guide block 257 is guided by the guide rail 261 having a vertical length to be lifted. The guide block 257 and the guide rail 261 may be formed, for example, as an LM guide.

The lifting member 256 on the other side is coupled to the guide block 258 by a fastening member (not shown), and the guide block 258 is guided by the guide rail 262 having a vertical length to be lifted. The guide block 258 and the guide rail 262 may be formed, for example, as an LM guide.

The guide rail 261 on the one side is integrally coupled to the driving portion support plate 263 on the one side, and the guide rail 262 on the other side is integrally coupled to the driving portion support plate 264 on the other side.

The cam member 252, the cam protruding portion 252*a*, the lifting member 255, the guide block 257, and the guide rail 261 on the one side included in the second power transmission portion 250 may be provided to be symmetrical to the cam member 253, the cam protruding portion 253*a*, the lifting member 256, the guide block 258, and the guide rail 262 on the other side.

A lift support 141 is provided above the lifting member 235 on the one side and the lifting member 236 on the other side of the first power transmission portion 230, and a lift support 142 is provided above the lifting member 255 on the one side and the lifting member 256 on the other side of the second power transmission portion 250.

The upper support plate 120 is stacked above the lift supports 141 and 142.

A rotational operation of the first rotational shaft 231 will be described with reference to FIGS. 8A and 8B.

FIG. 8A illustrates a position of the cam member 232 when the payload 100 has moved downward. The cam member 232 centered around the first rotational shaft 231 points toward about 7 to 9 o'clock, the cam protruding portion 232*a* is located inside the guide groove 235*a*, and the lifting member 235 and the guide block 237 have moved downward.

In a state shown in FIG. 8A, when the lifting motor 210 is driven, the first rotational shaft 231 and the cam member 232 rotate clockwise. As the cam member 232 rotates, the cam protruding portion 232*a* also rotates. The cam protruding portion 232*a* is caught by a top surface of the guide groove 235*a* and applies a force to allow the lifting member 235 to move upward. Accordingly, the lifting member 235 and the guide block 237 are guided by the guide rail 241 and move upward as shown in FIG. 8B so that the payload 100 is moved upward.

In a state shown in FIG. 8B, when the lifting motor 210 is driven to rotate in an opposite direction, the first rotational shaft 231 and the cam member 232 rotate counterclockwise and return to the state of FIG. 8A. Accordingly, the payload 100 is moved downward.

Although only the cam member 232 provided on the one side of the first rotational shaft 231 has been described above, the cam member 233 provided on the other side of the first rotational shaft 231 and the cam members 252 and 253 provided on the one side and the other side of the second rotational shaft 251 operate according to the same principle and a detailed description thereof will be omitted.

According to the above configuration, by lifting the payload 100 while supporting one side and the other side of the bottom of the payload 100 using one lifting motor 210 which is a lift-driving unit, since it is unnecessary to include a plurality of lifting motors, it is possible to simply configure the structure of a lift-driving portion.

Second Embodiment

Referring to FIGS. 9 to 11, a payload lifting device according to a second embodiment of the present invention includes a lift-driving portion 500 configured to vertically move a payload 400.

The payload 400 includes all items vertically moved by the lift-driving portion 500. As an example, in the case of a load transportation robot, the payload 400 may include a loading plate 410 on which an item to be transported is loaded. In a structure in which a rotation-driving portion 430 configured to rotate the loading plate 410 also rotates with the loading plate 410 due to the lift-driving portion 500, the rotation-driving portion 430 may be included in the payload 400.

The rotation-driving portion 430 includes a rotation-driving motor 434, a rotation-driving gear 433, a rotation-driving ring gear 431, and a bearing 432, is provided below the loading plate 410, moves upward with the loading plate 410, and rotates the loading plate 410. The rotation-driving portion 430 is provided on an upper support plate 420 and moves upward or downward as the upper support plate 420 moves upward or downward. A flange portion 420*a* is formed on the upper support plate 420, and the bearing 432 is coupled to an outside of the flange portion 420*a*. The rotation-driving portion 430 may have the same components as those in the first embodiment, and the components of the rotation-driving portion 130 of the first embodiment may be applied equally to components which are not described hereafter.

The lift-driving portion 500 is installed above an approximately quadrangular-panel-shaped base plate 610.

Driving portion support plates 543, 544, 563, and 564 are erectly installed above the base plate 610. The driving portion support plates 543, 544, 563, and 564 have a quadrangular plate shape, guide rails 541, 542, 561, and 562 (refer to FIG. 12) are coupled, and both ends of a first rotational shaft 531 and a second rotational shaft 551 are rotatably supported.

Components for linear movement are provided on the base plate 610.

Above the base plate 610, a first lower frame 621*a* and 621*b* having a front-rear length, a second lower frame 622*a* and 622*b* formed on a side opposite to the first lower frame 621*a* and 621*b* to have a shape symmetrical to that of the first lower frame 621*a* and 621*b*, a first connection frame 623 configured to connect inner surfaces of one sides of the first lower frame 621*a* and 621*b* and the second lower frame 622*a* and 622*b*, and a second connection frame 624 configured to connect inner surfaces of other sides of the first lower frame 621*a* and 621*b* and the second lower frame 622*a* and 622*b*.

On the first lower frame 621*a* and 621*b*, a first driving motor 631 configured to provide a driving force for linear movement and a decelerator 633 are provided and a driving wheel 641 connected to the decelerator 633 and rotated by driving of the first driving motor 631 is provided.

On the second lower frame 622*a* and 622*b*, a second driving motor 632 configured to provide a driving force for linear movement and a decelerator 634 are provided and a driving wheel 642 connected to the decelerator 634 and rotated by driving of the second driving motor 632 is provided.

Driven wheels 643 are coupled to the first connection frame 623, and driven wheels (not shown) are coupled to the second connection frame 624.

The lift-driving portion 500 is provided in an inner area surrounded by the first lower frame 621*a* and 621*b*, the second lower frame 622*a* and 622*b*, the first connection frame 623, and the second connection frame 624.

On the base plate 610, a cut-out portion 611 is formed to allow the driven wheels 643 to be located to pass through and cut-out portions 612*a* and 612*b* are formed to allow the driving wheels 641 and 642 to be located to pass through.

Upper parts of the driven wheels 643 are coupled to the first connection frame 623 and the driving wheels 641 and 642 are coupled to the first lower frame 621*b* and the second lower frame 622*b*, respectively.

The driven wheels 643 and the driving wheels 641 and 642 are configured to allow bottom surfaces of the wheels passing through the cut-out portions 611, 612*a*, and 612*b* to come into contact with the ground while the driven wheels 643 and the driving wheels 641 and 642 are coupled to the first connection frame 623, the first lower frame 621*b*, and the second lower frame 622*b*.

According to the above structure, it is possible to decrease an entire height of the device so as to facilitate miniaturization.

Components of the lift-driving portion 500 according to the second embodiment of the present invention will be described with reference to FIGS. 12 to 14.

The lift-driving portion 500 includes lift-driving units 510 and 520 configured to generate a driving force for vertically lifting the payload 400, a first power transmission portion 530 including first power transmission members 532, 535, 537, 541, 533, 536, 538, and 542 which vary in vertical positions and apply a vertically lifting force to one side of a bottom of the payload 400 when the first rotational shaft 531 rotated by the driving force of the lift-driving units 510 and 520 rotates, and a second power transmission portion 550 including second power transmission members 552, 555, 557, 561, 553, 556, 558, and 562 which vary in vertical positions and apply a vertically lifting force to the other side of the bottom of the payload 400 when the second rotational shaft 551 rotated by the driving force of the lift-driving units 5210 and 520 rotates.

The lift-driving units 510 and 520 may include a lifting motor 510 configured to provide a driving force of lifting the payload 400 and a deceleration portion 520 configured to decelerate a rotational speed of the lifting motor 510.

The lift-driving motor 510 may be provided between the first power transmission portion 530 and the second power transmission portion 550.

The deceleration portion 520 includes a first decelerator 521 connected to a motor shaft of the lifting motor 510 and configured to transmit the rotation of the lifting motor 510 to a deceleration portion rotational shaft 526 which meets the motor shaft of the lifting motor 510 at a right angle, a first deceleration portion gear 522 provided on one side of the deceleration portion rotational shaft 526, and a second deceleration portion gear 523 provided on the other side of the deceleration portion rotational shaft 526.

The deceleration portion rotational shaft 526 is rotatably supported by at least one rotational shaft support 529.

The first power transmission portion 530 is equal to the first embodiment in terms of including the first rotational shaft 531, cam members 532 and 533, lifting members 535 and 536 and has a difference from the first embodiment in terms of including a first rotational shaft gear 539 connected to the first deceleration portion gear 522 and a second rotational shaft gear 559 connected to the second deceleration portion gear 523.

Bearings are coupled to both ends of the first rotational shaft 531. The first rotational shaft 531, to which the bearings are coupled, is inserted into the driving portion support plates 543 and 544 so that the both ends pass therethrough and is rotatably supported thereby.

The first deceleration portion gear 522 and the first rotational shaft gear 539 are formed as worm gears so as to transmit rotation between the deceleration portion rotational shaft 526 and the first rotational shaft 531 which are two shafts intersecting each other. Also, since the first rotational shaft 531 is provided in a middle position of the first rotational shaft gear 539 connected to the first deceleration portion gear 522, the first rotational shaft 531 may be formed to have a length shorter than that of the first rotational shaft 231 of the first embodiment. Also, since it is unnecessary to include components such as the bearings 234*a* and 234*b* and the bearing-supporting blocks 245 and 246 of the first embodiment, a configuration may be simplified.

The first power transmission members 532, 535, 541, 533, 536, and 542 include the cam members 532 and 533, which protrude eccentrically outward from an outer circumferential surface of the first rotational shaft 531, the lifting members 535 and 536 linearly moved in a vertical direction by the rotation of the cam members 532 and 533, and the guide rails 541 and 542 configured to guide the linear movement of the lifting members 535 and 536.

The cam members 532 and 533 and the lifting members 535 and 536 may be provided one by one to apply a vertically lifting force to one side of the payload 400. In the embodiment, the pair of cam members 532 and 533 and a pair of the lifting members 535 and 536 are provided between a pair of the support plates 543 and 544.

On the cam member 532 protruding eccentrically outward from an outer circumferential surface of one side of the first rotational shaft 531, a cam protruding portion 532*a* having an approximate quadrangular shape and protruding from one surface of an outer end of the quadrangular shape in a direction parallel to a longitudinal direction of the first rotational shaft 531 is formed.

Also, on the cam member 533 protruding eccentrically outward from an outer circumferential surface of the other side of the first rotational shaft 531, a cam protruding portion 533*a* having an approximate quadrangular shape and protruding from one surface of an outer end of the quadrangular shape in a direction parallel to the longitudinal direction of the first rotational shaft 531 is formed.

The cam member 532 on the one side and the cam member 533 on the other side are formed at the same angle with respect to the first rotational shaft 531. That is, when viewed from an axial direction of the first rotational shaft 531, a phase of the cam member 532 on the one side is equal to a phase of the cam member 533 on the other side. Accordingly, when the first rotational shaft 532 rotates, the cam member 532 on the one side and the cam member 533 on the other side rotate together in the same phase and apply lifting forces to a bottom of one side of the payload 400 at the same time.

The cam protruding portion 532*a* on the one side protrudes from the cam member 532 toward the support plate 543 on the one side, and the cam protruding portion 533*a* on the other side protrudes toward the support plate 544 on the other side opposite that of the cam protruding portion 532*a* on the one side.

The pair of lifting members 535 and 536 include a lifting member 535 caught by the cam protruding portion 532*a* on the one side and lifted in a vertical direction and a lifting member 536 caught by the cam protruding portion 533*a* on the other side and lifted in a vertical direction.

The lifting member 535 on the one side has a hexahedral shape having a small thickness and include a guide groove 535*a* having a concave shape to have a length in a direction perpendicular to the longitudinal direction of the first rotational shaft 531 on the basis of a plan view so as to allow the cam protruding portion 532*a* to be inserted therein. The cam protruding portion 532*a* is guided inside the guide groove 535*a* and horizontally moves when the cam member 532 rotates.

The lifting member 536 on the other side has a shape symmetrical to the lifting member 535 on the one side. That is, the lifting member 536 includes a guide groove 536*a* having a concave shape to have a length in a direction perpendicular to the longitudinal direction of the first rotational shaft 531 on the basis of a plan view so as to allow the cam protruding portion 533*a* to be inserted therein. The cam protruding portion 533*a* is guided inside the guide groove 536*a* and horizontally moves when the cam member 533 rotates.

The guide groove 535*a* of the lifting member 535 on the one side and the guide groove 536*a* of the lifting member 536 on the other side may be formed to face in opposite directions.

In the second embodiment, the guide groove 535*a* on the one side and the guide groove 536*a* on the other side are configured to face each other but may be formed to face in opposite directions. That is, positions of the cam member 532 and the lifting member 535 on the one side may be reversed, positions of the cam member 533 and the lifting member 536 on the other side may be reversed, the cam protruding portion 532*a* on the one side and the cam protruding portion 533*a* on the other side may be configured to face each other, and the guide groove 535*a* on the one side and the guide groove 536*a* on the other side may be configured to face each other.

The guide rails 541 and 542 guide vertical movements of the lifting members 535 and 536.

Guide blocks 537 and 538 may be provided between the guide rails 541 and 542 and the lifting members 535 and 536.

The lifting member 535 on the one side is coupled to the guide block 537 by a fastening member (not shown), and the guide block 537 is guided by the guide rail 541 having a vertical length to be lifted. The guide block 537 and the guide rail 541 may be formed, for example, as an LM guide.

The lifting member 536 on the other side is coupled to the guide block 538 by a fastening member (not shown), and the guide block 538 is guided by the guide rail 542 having a vertical length to be lifted. The guide block 538 and the guide rail 542 may be formed, for example, as an LM guide.

The guide rail 541 on the one side is integrally coupled to the driving portion support plate 543 on the one side, and the guide rail 542 on the other side is integrally coupled to the driving portion support plate 544 on the other side.

The cam member 532, the cam protruding portion 532*a*, the lifting member 535, the guide block 537, and the guide rail 541 on the one side included in the first power transmission portion 530 may be provided to be symmetrical to the cam member 533, the cam protruding portion 533*a*, the lifting member 536, the guide block 538, and the guide rail 542 on the other side.

The second power transmission portion 550 may include the second rotational shaft 551, the cam members 552, and 553, and lifting members 555 and 556.

The second rotational shaft gear 559 connected to the second deceleration portion gear 523 is coupled to the second rotational shaft 551 to integrally rotate with the second rotational shaft 551.

Bearings are coupled to both ends of the second rotational shaft 551. The second rotational shaft 551, to which the bearings are coupled, is inserted into the driving portion support plates 563 and 564 so that the both ends pass therethrough and is supported thereby.

The second deceleration portion gear 523 and the second rotational shaft gear 559 are formed as worm gears so as to transmit rotation between the deceleration portion rotational shaft 526 and the second rotational shaft 551 which are two shafts intersecting each other. Also, since the second rotational shaft 551 is provided in a middle position of the second rotational shaft gear 559 connected to the second deceleration portion gear 523, the second rotational shaft 551 may be formed to have a length shorter than that of the second rotational shaft 251 of the first embodiment. Also, since it is unnecessary to include components such as the bearings 254*a* and 254*b* and the bearing-supporting blocks 265 and 266 of the first embodiment, a configuration may be simplified.

The second power transmission members 552, 555, 561, 553, 556, and 562 include the cam members 552 and 553, which protrude eccentrically outward from an outer circumferential surface of the second rotational shaft 551, the lifting members 555 and 556 linearly moved in a vertical direction by the rotation of the cam members 552 and 553, and the guide rails 561 and 562 configured to guide the linear movement of the lifting members 555 and 556.

The cam members 552 and 553 and the lifting members 555 and 556 may be provided one by one to apply a vertically lifting force to the other side of the payload 400. In the embodiment, the pair of cam members 552 and 553 and a pair of the lifting members 555 and 556 are provided between a pair of the support plates 563 and 564.

On the cam member 552 protruding eccentrically outward from an outer circumferential surface of one side of the second rotational shaft 551, a cam protruding portion 552*a* having an approximate quadrangular shape and protruding from one surface of an outer end of the quadrangular shape in a direction parallel to a longitudinal direction of the second rotational shaft 551 is formed.

Also, on the cam member 553 protruding eccentrically outward from an outer circumferential surface of the other side of the second rotational shaft 551, a cam protruding portion 553*a* having an approximate quadrangular shape and protruding from one surface of an outer end of the quadrangular shape in a direction parallel to the longitudinal direction of the second rotational shaft 551 is formed.

The cam member 552 on the one side and the cam member 553 on the other side are formed at the same angle with respect to the second rotational shaft 551. That is, when viewed from an axial direction of the second rotational shaft 551, a phase of the cam member 552 on the one side is equal to a phase of the cam member 553 on the other side. Accordingly, when the second rotational shaft 551 rotates, the cam member 552 on the one side and the cam member 553 on the other side rotate together in the same phase and apply lifting forces to a bottom of the other side of the payload 400 at the same time.

The cam protruding portion 552*a* on the one side protrudes from the cam member 552 toward the support plate 563 on the one side, and the cam protruding portion 553*a* on the other side protrudes toward the driving portion plate 564 on the other side opposite that of the cam protruding portion 552*a* on the one side.

The pair of lifting members 555 and 556 include a lifting member 555 caught by the cam protruding portion 552*a* on the one side and lifted in a vertical direction and a lifting member 556 caught by the cam protruding portion 553*a* on the other side and lifted in a vertical direction.

The lifting member 555 on the one side has a hexahedral shape having a small thickness and include a guide groove 555*a* having a concave shape to have a length in a direction perpendicular to the longitudinal direction of the second rotational shaft 551 on the basis of a plan view so as to allow the cam protruding portion 552*a* to be inserted therein. The cam protruding portion 552*a* is guided inside the guide groove 555*a* and horizontally moves when the cam member 552 rotates.

The lifting member 556 on the other side has a shape symmetrical to the lifting member 555 on the one side. That is, the lifting member 556 includes a guide groove 556*a* having a concave shape to have a length in a direction perpendicular to the longitudinal direction of the second rotational shaft 551 on the basis of a plan view so as to allow the cam protruding portion 553*a* to be inserted therein. The cam protruding portion 553*a* is guided inside the guide groove 556*a* and horizontally moves when the cam member 553 rotates.

The guide groove 555*a* of the lifting member 555 on the one side and the guide groove 556*a* of the lifting member 556 on the other side may be formed to face in opposite directions.

In the second embodiment, the guide groove 555*a* on the one side and the guide groove 556*a* on the other side are configured to face each other but may be formed to face in opposite directions. That is, positions of the cam member 552 and the lifting member 555 on the one side may be reversed, positions of the cam member 553 and the lifting member 556 on the other side may be reversed, the cam protruding portion 552*a* on the one side and the cam protruding portion 553*a* on the other side may be configured to face each other, and the guide groove 555*a* on the one side and the guide groove 556*a* on the other side may be configured to face each other.

The guide rails 561 and 562 guide vertical movements of the lifting members 555 and 556.

Guide blocks 557 and 558 may be provided between the guide rails 561 and 562 and the lifting members 555 and 556.

The lifting member 555 on the one side is coupled to the guide block 557 by a fastening member (not shown), and the guide block 557 is guided by the guide rail 561 having a vertical length to be lifted. The guide block 557 and the guide rail 561 may be formed, for example, as an LM guide.

The lifting member 556 on the other side is coupled to the guide block 558 by a fastening member (not shown), and the guide block 558 is guided by the guide rail 562 having a vertical length to be lifted. The guide block 558 and the guide rail 562 may be formed, for example, as an LM guide.

The guide rail 561 on the one side is integrally coupled to the driving portion support plate 563 on the one side, and the guide rail 562 on the other side is integrally coupled to the driving portion support plate 564 on the other side.

The cam member 552, the cam protruding portion 552*a*, the lifting member 555, the guide block 557, and the guide rail 561 on the one side included in the second power transmission portion 550 may be provided to be symmetrical to the cam member 553, the cam protruding portion 553*a*, the lifting member 556, the guide block 558, and the guide rail 562 on the other side.

FIG. 14 illustrates positions of the cam members 532 and 533 of the first power transmission portion 530 and the cam members 552 and 553 of the second power transmission portion 550 when the payload 400 is moved downward. Since operations of the first power transmission portion 530 and the second power transmission portion 550 are equal to each other, only the operation of the first power transmission portion 530 will be described.

The cam member 532 centered around the first rotational shaft 531 points toward about 7 to 9 o'clock, the cam protruding portion 532*a* is located inside the guide groove 535*a*, and the lifting member 535 and the guide block 537 have moved downward.

When the lifting motor 510 is driven in a state shown in FIG. 14, the deceleration portion rotational shaft 526 rotates. The rotation of the deceleration portion rotational shaft 526 is transmitted sequentially to the first deceleration portion gear 522 and the first rotational shaft gear 539 so that the first rotational shaft 531 and the cam member 532 integrally rotate together clockwise.

As the cam member 532 rotates, the cam protruding portion 532*a* also rotates. The cam protruding portion 532*a* is caught by a top surface of the guide groove 535*a* and applies a force to allow the lifting member 535 to move upward. Accordingly, the lifting member 535 and the guide block 537 are guided by the guide rail 541 and move upward as shown in FIG. 15 so that the payload 400 is moved upward.

In a state shown in FIG. 15, when the lifting motor 510 is driven to rotate in an opposite direction, the first rotational shaft 531 and the cam member 532 rotate counterclockwise and return to the state of FIG. 14. Accordingly, the payload 400 is to move downward.

Although only the cam member 532 provided on the one side of the first rotational shaft 531 has been described above, the cam member 533 provided on the other side of the first rotational shaft 531 and the cam members 552 and 553 provided on the one side and the other side of the second rotational shaft 551 operate according to the same principle and a detailed description thereof will be omitted.

According to the above configuration, by lifting the payload 400 while supporting one side and the other side of the bottom of the payload 400 using one lifting motor 510 which is a lift-driving unit, since it is unnecessary to include a plurality of lifting motors, it is possible to simply configure the structure of a lift-driving portion.

Also, since both ends of the deceleration portion rotational shaft 526 are connected to central parts of the first rotational shaft 531 and the second rotational shaft 551, a power transmission structure may be simplified, the first rotational shaft 531 and the second rotational shaft 551 may be formed to have short lengths, and components such as bearings for supporting the first rotational shaft 531 and the second rotational shaft 551 are unnecessary.

According to the present invention, since a payload is lifted while one side and the other side of a bottom of the payload are supported using one lifting driving unit, it is unnecessary to provide a plurality of lift-driving units and thus it is possible to simply configure the structure of the lift-driving units.

Although the exemplary embodiments of the present invention have been described above, the present invention is not limited to the above-described embodiments and may be modified into a variety of forms within the scope of the claims, the detailed description, and the attached drawings of the present invention, which are also included in the present invention.

What is claimed is:

1. A payload lifting device comprising a lift-driving portion configured to vertically lift a payload, wherein the lift-driving portion comprises:

lift-driving units configured to generate a driving force for vertically lifting the payload;

a first power transmission portion comprising first power transmission members which vary in vertical positions and apply a vertically lifting force to one side of a bottom of the payload when a first rotational shaft rotated by the driving force of the lift-driving units rotates; and a second power transmission portion comprising second power transmission members which vary in vertical positions and apply a vertical lifting force to the other side of the bottom of the payload when a second rotational shaft rotated by the driving force of the lift-driving units rotates, wherein the first power transmission members comprise cam members which protrude eccentrically outward from an outer circumferential surface of the first rotational shaft and lifting members which linearly move in a vertical direction due to rotation of the cam members, the second power transmission members comprise cam members which protrude eccentrically outward from an outer circumferential surface of the second rotational shaft and lifting members which linearly move in a vertical direction due to rotation of the cam members, the first rotational shaft and the second rotational shaft are provided in parallel, a cam protruding portion protruding in a direction parallel to a longitudinal direction of the first rotational shaft and the second rotation shaft is formed on one surface of each of the cam members, a guide groove having a concave shape to have a length in a direction perpendicular to the longitudinal direction of the first rotational shaft and the second rotational shaft on the basis of a plan view to allow the cam protruding portion to be inserted therein is formed in each of the lifting members, and when the cam member rotates, the cam protruding portion horizontally moves inside the guide groove.

2. The payload lifting device of claim 1, wherein a guide block is coupled to the lifting member, and wherein the guide block is guided by a guide rail to be lifted.

3. The payload lifting device of claim 1, wherein the cam member and the lifting member of the first power transmission portion are provided on each of both sides of the first rotational shaft, and the cam member and the lifting member of the second power transmission portion are provided on each of both sides of the second rotational shaft.

4. The payload lifting device of claim 3, wherein the cam protruding portions of the cam members provided on both sides of the first power transmission portion protrude in opposite directions, and the guide grooves of the lifting members on both sides of the first power transmission portion are formed facing opposite directions, and wherein the cam protruding portions of the cam members provided on both sides of the second power transmission portion protrude in opposite directions, and the guide grooves of the lifting members on both sides of the second power transmission portion are formed facing opposite directions.

5. The payload lifting device of claim 3, wherein at least one bearing fitted onto the first rotational shaft is provided between the cam members on both sides of the first power transmission portion, wherein at least one bearing fitted onto the second rotational shaft is provided between the cam members on both sides of the second power transmission portion, wherein a bearing-supporting block configured to support a bottom of the bearing is provided at a position spaced apart from the cam members on the both sides of the first power transmission portion, and wherein a bearing-supporting block configured to support a bottom of the bearing is provided at a position spaced apart from the cam members on the both sides of the second power transmission portion.

6. The payload lifting device of claim 1, wherein the lift-driving units comprise:

a lifting motor;

a decelerator configured to decelerate a rotation speed of the lifting motor; and a deceleration portion rotational shaft connected to the decelerator and having both ends provided in a middle position between the first rotational shaft and the second rotational shaft to transmit power thereto.

7. The payload lifting device of claim 6, wherein a first deceleration portion gear and a second deceleration portion gear are provided on both sides of the deceleration portion rotational shaft, the first deceleration portion gear is connected to a first rotational shaft gear provided on the first rotational shaft, and the second deceleration portion gear is connected to a second rotational shaft gear provided on the second rotational shaft.

8. The payload lifting device of claim 1, wherein the lift-driving units comprise:

a lifting motor;

at least one decelerator configured to decelerate a rotation speed of the lifting motor; and a deceleration portion rotational shaft connected to the decelerator and having both ends connected to one end of the first rotational shaft and one end of the second rotational shaft to transmit power thereto.

9. The payload lifting device, comprising a lift-driving portion configured to vertically lift a payload, wherein the lift-driving portion comprises:

lift-driving units configured to generate a driving force for vertically lifting the payload;

a first power transmission portion comprising first power transmission members which vary in vertical positions and apply a vertically lifting force to one side of a bottom of the payload when a first rotational shaft rotated by the driving force of the lift-driving units rotates; and a second power transmission portion comprising second power transmission members which vary in vertical positions and apply a vertical lifting force to the other side of the bottom of the payload when a second rotational shaft rotated by the driving force of the lift-driving units rotates, wherein the lift-driving units comprise a lifting motor and a deceleration portion configured to decelerate a rotational speed of the lifting motor, and wherein the deceleration portion further comprises:

a first decelerator connected to a motor shaft of the lifting motor and configured to transmit rotation of the lifting motor to a deceleration portion rotational shaft which meets the motor shaft at a right angle;

a second decelerator connected to one end of the deceleration portion rotational shaft and configured to transmit rotation of the deceleration portion rotational shaft to the first rotational shaft which meets the deceleration portion rotational shaft at a right angle; and a third decelerator connected to the other end of the deceleration portion rotational shaft and configured to transmit rotation of the deceleration portion rotational shaft to the second rotational shaft which meets the deceleration portion rotational shaft at a right angle and is provided at a position facing the first rotational shaft.

* * * * *